US006645032B2

(12) United States Patent
Barringer et al.

(10) Patent No.: US 6,645,032 B2
(45) Date of Patent: Nov. 11, 2003

(54) ERECTION SET—POSTS AND PANELS

(76) Inventors: Charles E. Barringer, 7422 Marisol Dr., Houston, TX (US) 77083; Carmen Barringer, 7422 Marisol Dr., Houston, TX (US) 77083

( * ) Notice: Subject to any disclaimer, the term of this patent is extended or adjusted under 35 U.S.C. 154(b) by 0 days.

(21) Appl. No.: 10/000,215

(22) Filed: Oct. 23, 2001

(65) Prior Publication Data

US 2003/0077975 A1 Apr. 24, 2003

(51) Int. Cl.[7] ..... A63H 33/08
(52) U.S. Cl. ..... 446/108; 446/122; 446/124
(58) Field of Search ..... 446/85, 102, 105, 446/106, 108–115, 119, 124, 122, 127, 476; 434/72, 77, 79

(56) References Cited

U.S. PATENT DOCUMENTS

| | | | | | |
|---|---|---|---|---|---|
| 797,640 | A | | 8/1905 | Thompson | |
| 1,492,560 | A | | 5/1924 | Fisher | |
| 1,828,309 | A | | 10/1931 | Berger | |
| 3,132,443 | A | * | 5/1964 | Kuhn | 446/112 |
| 3,571,965 | A | | 3/1971 | Gibb | |
| 4,186,533 | A | * | 2/1980 | Jensen | 52/184 |
| 4,270,302 | A | | 6/1981 | Dandia | |
| 4,334,868 | A | | 6/1982 | Levinrad | |
| 5,036,634 | A | * | 8/1991 | Lessard et al. | 52/79.1 |
| 5,779,517 | A | | 7/1998 | Clarke | |
| 6,073,404 | A | | 6/2000 | Norfleet | |

* cited by examiner

*Primary Examiner*—Derris H. Banks
*Assistant Examiner*—Bena B. Miller
(74) *Attorney, Agent, or Firm*—Law Office of Craig Bohn; Craig E. Bohn

(57) ABSTRACT

A modular toy construction system employing frictional channel connections, which supports combining an assortment of simple modular components without special tools. The system includes a series of post, panels and foundation pieces. Channels are pre-cut to allow the panels to slide into place, or for connectors to seat in the channels of adjacent pieces forming a clean joint between two channeled parts. Assembly in this fashion provides a friction fit and achieves substantial stability. This stability is present in completed and partially assembled structures, allowing whole projects or sections thereof to be moved during construction with minimal risk of structural collapse. The system supports the possibilities of a wide variety of configurations and specialty pieces, which may be added to effect distinct characteristics, features and looks.

21 Claims, 5 Drawing Sheets

ERECTION SET— POSTS AND PANELS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates generally to toy construction systems, and particularly to erection systems having a plurality of elements, which may be put together in a variety of ways to form various structures.

2. Desciption of the Related Art

Toy construction systems with posts and panels, designed in a modular nature are known to the prior art. The following patents illustrate such systems:

U.S. Pat. No. 797,640 discloses a toy house having channeled posts, panels to slide into the channels and transverse post notches for interconnecting posts.

U.S. Pat. No. 1,492,560 discloses building blocks including posts with channels on all four sides, panels to slide into the channels, transverse post notches for interconnecting posts and dowels extending from some post ends. The dowels engage round holes provided in panels and other posts, but not the post channels.

U.S. Pat. No. 1,828,309 discloses a structural building unit having tension connectors to position and hold components together.

U.S. Pat. No. 3,571,965 discloses a construction unit having channeled posts, rectangular structural pegs at the end of at least some posts, and holes in the post channels from which round pegs can protrude in order to support panels engaged in the channels.

U.S. Pat. No. 4,270,302 discloses an erection set including a solid base with positioning apertures, panels and channeled posts such that the post shape ends securely fit in base apertures.

U.S. Pat. No. 4,334,868 discloses a construction kit with channeled posts and panels that press into the channels, where posts can only connect to panels, and vice versa. Panels are securely fixed in the posts by friction.

U.S. Pat. No. 5,036,634 discloses a structure including channeled posts, panels to slide into the channels and transverse post notches for interconnecting posts.

U.S. Pat. No. 5,779,517 discloses a construction kit with a one-piece structural base, posts with channels, panels to slide into the channels, and dowels extending from the vertical post ends to position posts on base unit.

U.S. Pat. No. 6,073,404 discloses a modular building using tension hooks and threaded connectors for maintaining base to base and base to wall component continuity.

In order to access the benefits of creative play, toy construction systems have attempted to incorporate certain characteristics and features, such as simply configured interlocking construction components, variable assembly options, and structural stability during and after construction. To obtain these features, sets have employed various techniques.

Frequently, to provide structural stability, many systems employed some type of single-piece base component taught in U.S. Pat. No. 797,640 issued to Thompson on Aug. 22, 1905, U.S. Pat. No. 3,571,965 issued to Gibb on Mar. 23, 1971, U.S. Pat. No. 4,270,302 issued to Dandia on Jun. 2, 1981, and U.S. Pat. No. 5,779,517 issued to Clarke on Jul. 14, 1998, or an interlocking foundation component as taught in U.S. Pat. No. 1,492,560 issued to Fisher on May 6, 1924, U.S. Pat. No. 5,036,634 issued to Lessard et al. on Aug. 6, 1991, or U.S. Pat. No. 6,073,404 issued to Norfleet on Jun. 13, 2000. The single-piece base systems have limited flexibility in their design and a single-piece base restricts the compactness of the disassembled construction set. The interlocking systems either employ intricate hooking or threaded devices more difficult for younger, less skilled users, or larger, less flexible hands to manipulate, or they use a notched transverse post configuration producing a more bulky, unsightly union.

Many construction sets use channeled posts with panels that slideably engage the posts to create wall structures as taught by U.S. Pat. No. 797,640 issued to Thompson on Aug. 22, 1905, U.S. Pat. No. 1,492,560 issued to Fisher on May 6, 1924, U.S. Pat. No. 3,571,965 issued to Gibb on Mar. 23, 1971, U.S. Pat. No. 4,270,302 issued to Dandia on Jun. 2, 1981, and U.S. Pat. No. 5,779,517 issued to Clarke on Jul. 14, 1998. Additionally, some of these post and panel constructions use pegs at the end of the vertical posts, or the shape of the post itself, to define placement locations for components in the base component and provide structural rigidity as taught in U.S. Pat. No. 1,492,560 issued to Fisher on May 6, 1924, U.S. Pat. No. 3,571,965 issued to Gibb on Mar. 23, 1971, U.S. Pat. No. 4,270,302 issued to Dandia on Jun. 2, 1981 and U.S. Pat. No. 5,779,517 issued to Clarke on Jul. 14, 1998.

Finally, prior construction toys have offered limited assembly configurations due to specific purpose design components. As noted above, the single-piece base units have inherent limited design flexibility, because the construction is confined within the limits of the structural base. But, even sets with interlocking foundations have limitations to their expandability, requiring users to create within the realm supported by the specialized wall panel systems. A construction foundation layout developed by the user, connected and expanded at the user's discretion to specifically support the user's current creation, and allowing for addition without disassembly of present design offers benefits over the prior art.

BRIEF SUMMARY OF THE INVENTION

Accordingly, objects of my modular toy construction set invention, inter alia, are to provide:

- flexibility of design
- ease of assembly
- stability in assembled components
- compact disassembled storage
- expandability in order to incorporate new components and create large projects
- encouragement of creativity and imagination Other objects of my invention will become evident throughout the reading of this application.

My invention is a modular toy construction system employing a frictional channel connection system, which supports combining an assortment of simple modular components without special tools. The system includes a series of post, panels, foundation pieces and connectors. Channels are pre-cut to allow the panels to slide into place, or for connectors to seat in the channels of adjacent pieces forming a clean interface between two channeled parts. Assembly in this fashion provides a friction fit, achieving substantial stability. This stability is present in both completed and partially assembled structures, allowing whole projects or sections thereof to be moved during construction with minimal risk of structural collapse. The system supports the possibilities of a wide variety of configurations and specialty pieces, which may be added to effect distinct characteristics, features and looks.

DETAILED DESCRIPTION OF THE INVENTION

Figure 1:
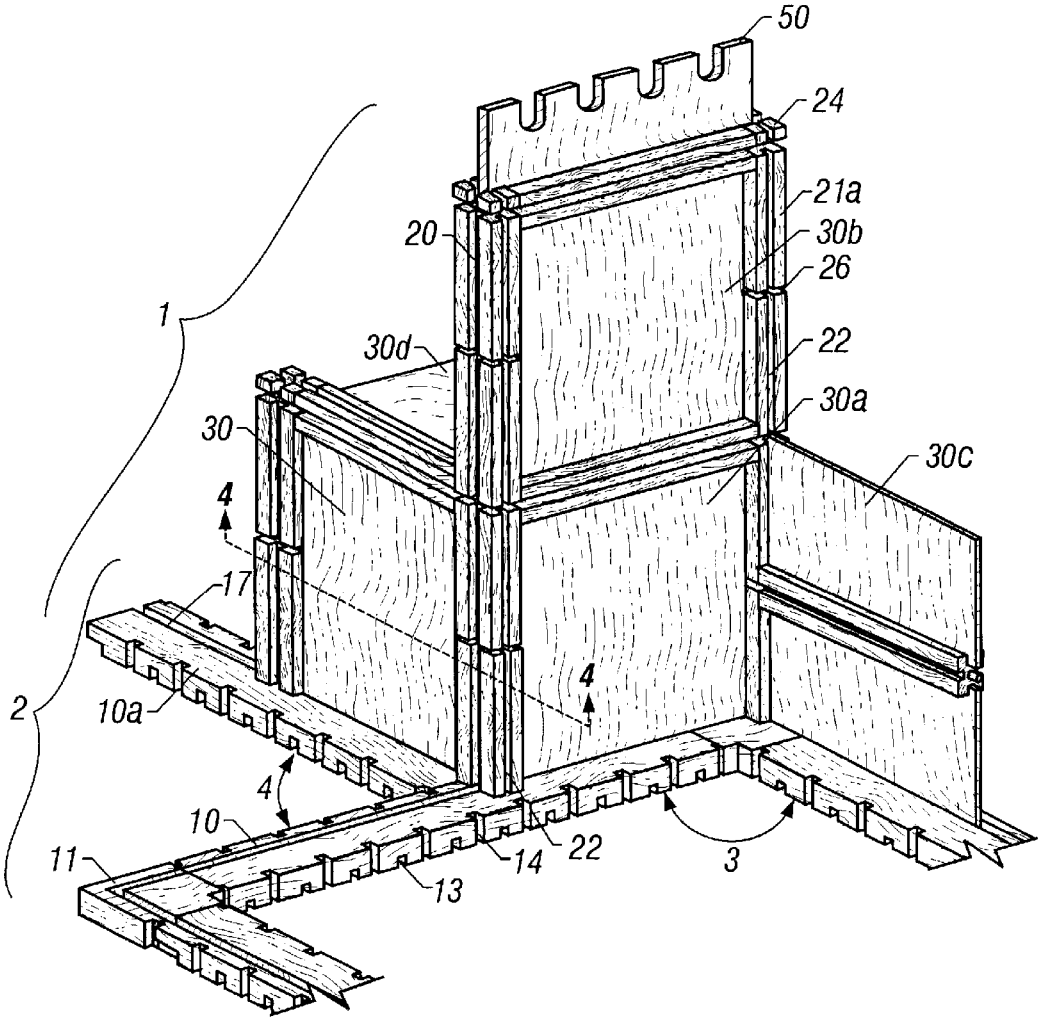
FIG. 1 is a perspective view of the top of a construction segment.

FIG. 1 is a perspective view of an exemplary construction segment 1 buildable with this invention. Construction segment 1 shows various construction components and a method of employing those components. The structure is based on a modular foundation 2 comprised primarily of foundation pieces 10, of various lengths. Foundation connectors, exemplified in FIG. 3A through FIG. 3E, when employed in the connector receivers of adjoining pieces retain such pieces in fixed relationship, thereby providing a rigid integrated support structure. Likewise, the wall panels 30 are received by and snugly seated in the posts 20 and foundation pieces 10. Such integrated support of adjoining pieces provides the stability for structures built using the system of the present invention.

The components may vary in scale sizes, with all sizes based on multiples of the base unit of length. The base unit of length is standard throughout compatible components.

Figure 2:
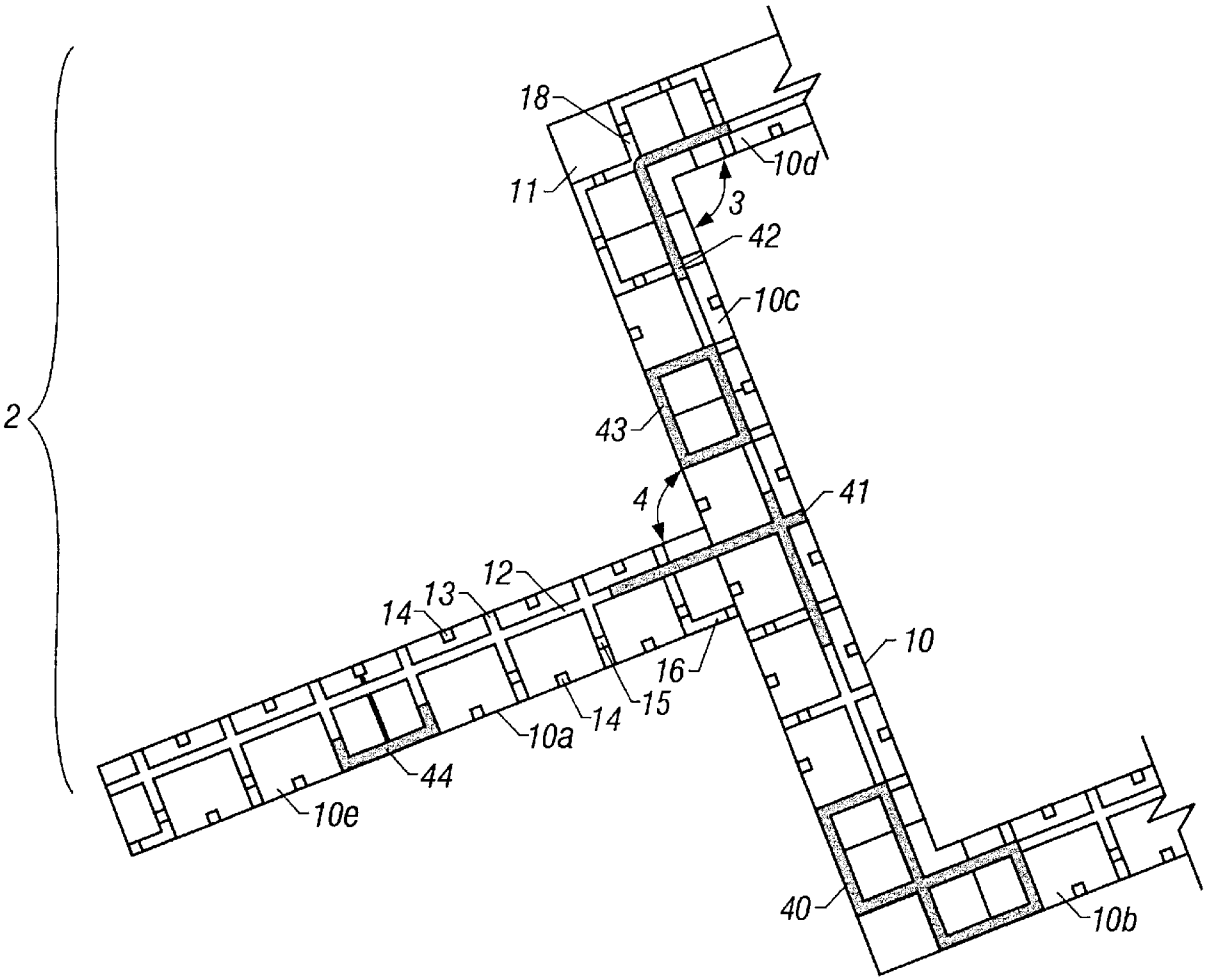
FIG. 2 is a perspective view of the bottom of the construction segment.

FIG. 2 shows the underside of the exemplary embodiment of assembled modular foundation 2. The exemplary foundation pieces 10 and foundation corner pieces 11 each include a foundation bottom groove 12 and multiple, uniformly spaced foundation channels 13, foundation notches 14, foundation perforations 15, and foundation end channels 16 at the end of each piece for receiving the attachment of other components. Different embodiments of the invention may vary the number, orientation and spacing of the foundation bottom groove 12, foundation channel 13, foundation notches 14, foundation perforations 15 or foundation end channels 16 receivers without departing from the scope of the invention.

In the exemplary embodiment, an angle 3 in the modular foundation 2 is achieved through the use of a foundation corner piece 11. The exemplary foundation corner piece 11 forms a 90° angle 3, but the invention supports angle 3 of greater and lesser degree. Referring to FIG. 1 and FIG. 2, another angle 4 in the modular foundation 2 is formed by attaching to the side of one foundation piece 10 with the end of another foundation piece 10*a*. In the exemplary embodiment of the modular foundation 2 this option is demonstrated at the junction of foundation pieces 10 and 10*a* in FIGS. 1 and 2, and creates an angle 4. The angle 4 is again 90°, but here too the invention supports angles 4 of greater and lesser degree.

This angle 4 may be secured in various ways, either individually or in combination. Referring to FIGS. 1 and 4, one way is by the friction of the panels received and seated in the post channel 22, foundation notch 14 and foundation top groove 17. Another way, referring to FIG. 2 and FIG. 3B, is by use of a cross connector 41, or other inlay connector (not shown) of suitable configuration, securely received and seated in the foundation bottom groove 12 and foundation channels 13.

Figure 3A:
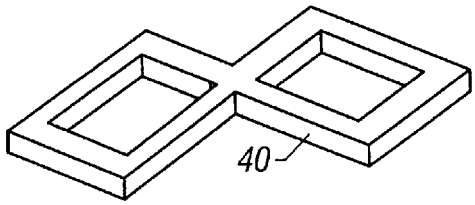
FIGS. 3*a–e* are perspective views of individual connectors.

Referring to FIGS. 2 and 3A, double connector 40 seats in the foundation bottom grooves 12 of foundation piece 10 and 10*b*, and foundation corner piece 11. Additionally, double corner connector 40 seats in a foundation channel 13 and foundation end channel 16 of each foundation piece 10 and 10*b*. All foundation pieces 10 and 10*b* and foundation corner piece 11 are all thereby integratedly secured.

Figure 3B:
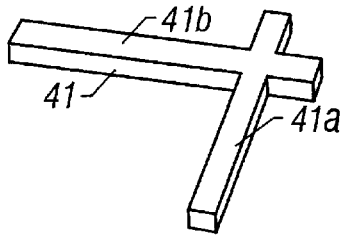
Figure 4:
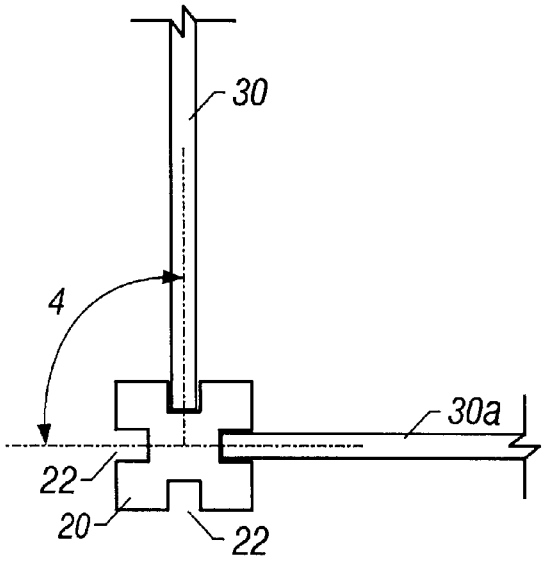
FIG. 4 is a partial sectional view of the construction segment in FIG. 1, cut at line 4—4.

Referring to FIG. 3B, cross connector 41 also secures corners in the modular foundation 2. In the exemplary embodiment it secures the corner at the intersection of foundation pieces 10 and 10*a* creating angle 4. While a first arm 41*a* of cross connector 41 seats in the foundation bottom groove 12 of foundation piece 10, the second arm 41*b* seats in a foundation channel 13 of foundation piece 10 and extends in to the foundation bottom groove 12 of foundation piece 10*a*. Cross connector 41 can alternately be used to secure a foundation corner piece 11 with two foundation pieces 10 and 10*b*. The first arm 41*a* seats in the foundation bottom groove 12 of the first foundation piece 10 and extends into the foundation corner grooves 18. The second arm 41*b* seats in the foundation bottom groove 12 of the second foundation piece 10*b* and extends into the other branch of the foundation corner groove 18.

Figure 3C:
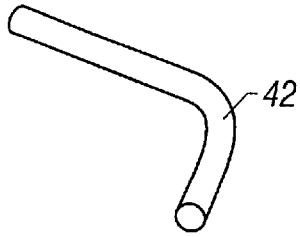

Referring to FIG. 2 and FIG. 3C, an alternative way to secure a corner is with single corner connector 42. When the corner is made with a foundation corner piece 11, the single corner connector 42 seats in the foundation corner groove 18 and extends to the foundation bottom grooves 12 of both the first foundation piece 10*c* and second foundation piece 10*d*. Alternately, single corner connector 42 may be used to secure foundation pieces 10 and 10*a* to form angle 4. In that instance single corner connector 42 seats in foundation bottom groove 12 and foundation channel 13 of foundation piece 10 and extends to seat in foundation bottom groove 12 of foundation piece 10*a*.

Figure 3D:
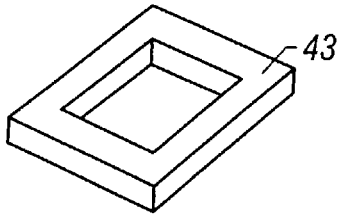
Figure 3E:
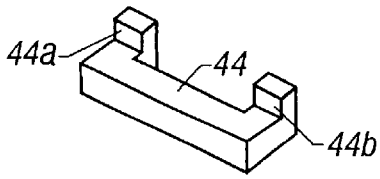

Linear connections of foundation pieces 10 can be made with double linear connectors 43 or linear perforation connectors 44, as seen in FIG. 2, FIG. 3D and FIG. 3E. When double linear connector 43 is employed it seats in the foundation bottom groove 12, and a foundation channel 13 and foundation end channel 16 of each foundation bottom piece 10 and 10*c*. When the linear perforation connector is employed it seats in a foundation end channel 16 and part of a foundation channel 13 of both foundation piece 10*a* and foundation piece 10*e*. Referring to FIGS. 2 and 3E, perforation tab 44*a* seats in a foundation perforation 15 in the last foundation channel 13 of foundation piece 10*a* and perforation tab 44*b* seats in a foundation perforation 15 in the last foundation channel 13 of foundation piece 10*e*. Other connectors (not shown) can be fashioned to be firmly received in specific sections of foundation bottom grooves 12, foundation channels 13, foundation perforations 15, and foundation end channels 16, and are anticipated by this invention.

It would be clear to one skilled in the art that angles 3 or 4 in FIGS. 1, 2 and 4, being greater or lesser than 90°, may require some modification of the standard foundation piece 10, post 20 and wall 30 shown. Such modifications may include angling the end of the foundation piece 10 to match the angle of the desired angle; a post 20 having three to six sides, with the angle between adjacent post channels 22 varying in degree, but less that 180°; or a wall 30 having a section angled so the section occupies a different plane that the primary part of the wall 30 and the intersection of the two planes are a line parallel with a side of wall 30. In each of these cases the frictional stability of the resulting structure is maintained because the pieces fit snugly and cleanly abut on adjoining surfaces, and into corresponding receivers.

Figure 5A:
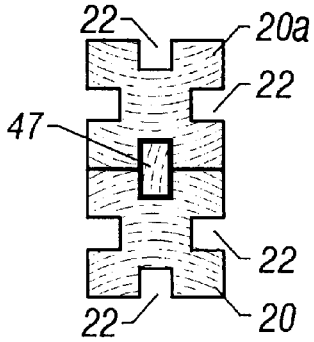
FIG. 5*a* is an end sectional view of two interconnected posts.
Figure 5B:
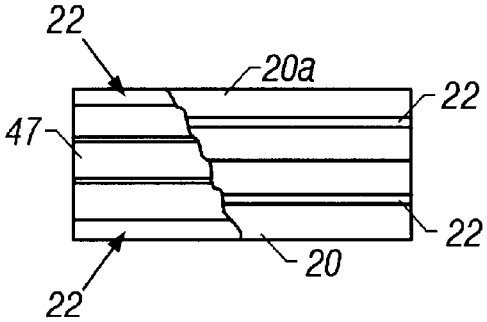
FIG. 5*b* is a side partial sectional view of two interconnected posts.
Figure 6:
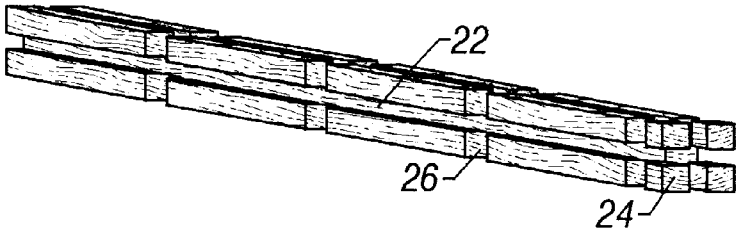
FIG. 6 is a perspective view of the notched end of a notched post.
Figure 7:
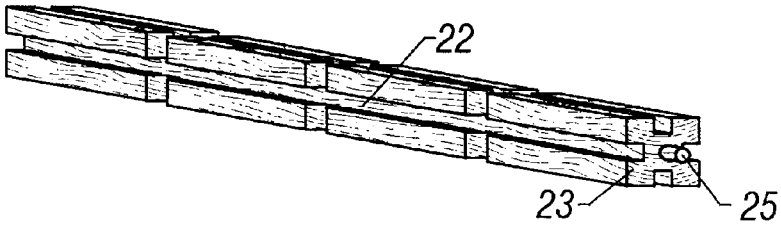
FIG. 7 is a perspective view of the pegged end of either a pegged post or a notched post.

Referring to FIGS. 5 and 6, either a post 20 or a foundation piece 10, may be securely connected to a second post 20*a* or foundation piece 10, by means of an interconnetor piece 47, which, being the same width and twice the depth as the post channel 22, creates a firm abutment between the receivers of two similar components.

Figure 8:
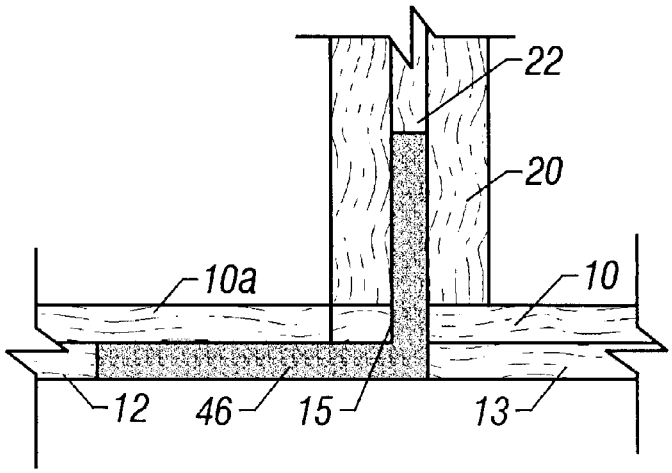
FIG. 8 is a side partial sectional view of a perforation connector.

FIG. 8 shows an exemplary embodiment of a perforation connector 46 extending up through a foundation perforation 15 of foundation piece 10 to be securely seated in the post channel 22 of notched post 20, the foundation channel 13 of foundation piece 10, and the foundation bottom groove 12 of foundation piece 10*a*. In this manner the perforation connector secures the foundation piece 10 and foundation piece 10*a*, as well as anchoring notched post 20 in its position in foundation top groove 17; an important factor when post 20 forms a door or window frame with no solid wall panel 30 on the side opposite perforation connector 46. Perforation connector 46 can be structured to have the portion situated above the level of the foundation perforation 15 be of double width so as to inlay in both post channels 22 of 10 and 10*a*, when they are appropriately positioned around a perforation, so as to act as an interconnector piece 47 shown in FIGS. 5 and 6.

Referring to FIGS. 2, 3A through 3E, 4, 5A, 5B, and 8, the inlay pieces have a generally circular or rectangular cross section, sized to snugly fit into the depth and width of the foundation bottom groove 12, foundation channel 13, foundation notch 14, foundation perforation 15, foundation end channel 16 or post channel 22 connector receivers. Inlay connectors used in the bottom side of the foundation piece 10 or foundation corner piece 11 may seat entirely within the groove, so as to provide a flat surface when the foundation is oriented for construction. Such configuration provides the friction forces that produce the integrated support stability of the system of the present invention, while permitting the parts to be readily pried apart and reconfigured as the user desires.

Referring to FIGS. 1, 6 and 70, the walls of construction segment 1 are formed from upright posts 20 with wall panels 30 received and secured in the post channels 22, and received and seated in the foundation top groove 17. Walls are made taller by connecting horizontal pegged posts 21*b* on the upper edge of a first wall panel 30*a*, engaging the peg 25 of both of the post pegged ends 23 into the post channel 22 of the vertical posts 20. A second wall panel 30*b* can then be slid down the post channels 22 in the vertical posts 20, to securely engage the post channel 22 in the horizontal pegged post 21*b*. Pegs 25 provide positioning guidance to ensure post 20 alignment. Pegs 25 are freely positionable in post channel 20 and are vertically supported by the underlying construction component, which in construction segment 1 is wall panel 30. Wall components may be of varied sizes, based on the base unit of length for the particular set, while still staying modularly compatible. FIG. 1 illustrates a horizontal implementation of the half wall piece 30*c*.

Adding a horizontal post 21*c* to the top of the second wall panel 30*b* allows for a stylized panel 50 to be received and secured in the post channel 22 of horizontal post 21*c* at the top of the construction segment 1, providing stylistic features to the configuration. Using notched posts 21*a* in a vertical position places post notched ends 22 at the upper level of the construction segment 1. This allows customized corner pieces (not shown) or pieces like stylized panel 50 to be secured in the corner's post end notch 24. In addition to stylized components, embodiments of the invention may possess stylized textures (not shown) on the surfaces of the components, in order to provide the simulated look of particular construction materials.

In the exemplary embodiment the vertical posts 20 have post side notches 26 to accommodate upper floor segments 30*d*. Wall panels 30 become upper floor segments 30*d* if they are positioned horizontally. Embodiments of wall panels 30 with greater spans do not require as many horizontal connective posts 20.

An alternative embodiment may employ positioning foundation piece 10 on top of wall panel 30 in order to develop a higher-level modular foundation 2. Such a configuration would allow for balcony or loft structures to be incorporated into the structural designs. When the foundation bottom groove 12 and foundation channel 13 are the same dimensions as the foundation top groove 17, the wall panels 30 will just as readily be received by and seat in one as the others.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

We claim:

1. A modular toy construction system, comprising:

a plurality of foundation pieces, posts, panels, and connectors;

each of said panels having at least one panel edge;

each of said panel edges having an edge width;

each of said foundation pieces and each of said posts possessing receivers for receiving said panels;

each of said receivers having widths equivalent to said edge widths for frictional fit of said panel edges in said receivers;

each of said panel edges fitting securely into a receiver for frictionally joining a panel with at least one of said foundation pieces and said posts;

each of said foundation pieces having a bottom;

a plurality of said bottoms having at least one connector receiver;

each of said connectors sized so as to fit securely into a plurality of connector receivers for frictionally joining a combination of said foundation pieces to each other;

said foundation pieces and connectors operable to form stable combinations of said foundation pieces to each other; and said panels, posts and foundation pieces operable to form stable combinations of panels with foundation pieces and posts.

2. The modular toy construction system in claim 1, further comprising:

a base unit of length for foundation pieces, posts and panels; and said plurality of foundation pieces, posts and panels being of assorted lengths, such lengths being multiples of said base unit of length.

3. The modular toy construction system of claim 1, further comprising:

each of said foundation pieces having a foundation top, a foundation inside edge and a foundation outside edge;

each of said foundations tops having at least one top groove parallel to said foundation outside edge;

said top groove comprising said receivers;

each of said foundation bottoms having at least one bottom groove parallel to said foundation piece outside edge; and said bottom groove comprising said connector receivers.

4. The modular toy construction system of claim 3, further comprising:

each of said foundation bottoms having a plurality of foundation channels perpendicular to said foundation piece outside edge; and said plurality of foundation channels comprising said connector receivers.

5. The modular toy construction system of claim 4, further comprising:

each of said post sides having a longitudinal post channel;

each of said post channels comprising said receivers.

6. The modular toy construction system in claim 5, further comprising:

each of said posts having three to six sides.

7. The modular toy construction system in claim 6, further comprising:

an angle between adjacent at least two of said post channels of a said post being less than 180°.

8. The modular toy construction system in claim 3, further comprising:

said foundation piece outside edges and inside edges having a plurality of foundation notches spaced apart; and said notches comprising said receivers.

9. The modular toy construction system in claim 5, further comprising:

each of said posts having a first end and a second end;

each of said first post ends having a peg protruding longitudinally from the end of said first post end; and each of said pegs having a width equivalent to said panel edge width;

said pegs receivable in said receivers.

10. The modular toy construction system in claim 9, further comprising:

a plurality of said posts comprising peg posts having a peg on said second post end;

a plurality of said posts comprising notch posts having post notches in said second post end;

said post notches comprising continuations of said post channels around said second ends;

said post notches intersecting at the apex of said second post end; and said post notches comprising said receivers.

11. The modular toy construction system in claim 10, further comprising:

each of said pegs of said plurality of notch and peg posts freely positionable in said receivers.

12. The modular toy construction system in claim 1, further comprising:

said connector receivers being the same width as said receivers.

13. The modular toy construction system of claim 1, further comprising:

each of said foundation pieces having a plurality of perforations extending from said foundation groove through said foundation top groove; and at least one connector having an angle and an extended segment such that said connector is receivable in both said foundation bottom groove and at least one of said plurality of perforations.

14. The modular toy construction system in claim 1, further comprising:

a plurality of interconnectors;

each of said interconnectors having interconnector edge widths, said interconnector edge widths being equivalent to said panel edge widths;

each of said interconnector edges being frictionally receivable in said receivers; and each of said interconnectors being capable of frictionally securing two of said posts and foundation pieces.

15. The modular toy construction system in claim 1, further comprising:

a plurality of said panels being flat panels; and a plurality of said panels being angled panels.

16. The modular toy construction system in claim 1, further comprising:

a plurality of said panels having at least one distinctive panel surface consistent with a construction option configuration; and a plurality of said posts having at least one distinctive post surface consistent with a construction option configuration.

17. A modular toy construction system, comprising:

a plurality of foundation pieces, posts, panels, and connectors;

a base unit of length for foundation pieces, posts and panels;

said plurality of foundation pieces, posts and panels being of assorted lengths, such lengths being multiples of said base unit of length;

each of said panels having at least one panel edge;

each of said panel edges having an edge width;

each of said foundation pieces and each of said posts possessing receivers for receiving said panels;

each of said receivers having widths equivalent to said edge widths for frictional fit of said panel edges in said receivers;

each of said panel edges fitting securely into a receiver for frictionally joining a panel with at least one of said foundation pieces and said posts;

each of said foundation pieces having a foundation top, a foundation bottom, a foundation inside edge and a foundation outside edge;

each of said foundations tops having at least one top groove parallel to said foundation outside edge;

said top groove comprising said receivers;

a plurality of said foundation bottoms having at least one connector receiver;

said connector receivers being the same width as said receivers;

each of said foundation bottoms having at least one bottom groove parallel to said foundation piece outside edge;

said bottom groove comprising said connector receivers;

each of said connectors sized so as to fit securely into a plurality of connector receivers for frictionally joining a combination of said foundation pieces to each other;

said foundation pieces and connectors operable to form stable combinations of said foundation pieces to each other;

said foundation piece outside edges and inside edges having a plurality of foundation notches spaced apart;

said notches comprising said receivers;

each of said foundation pieces having a plurality of perforations extending from said foundation groove through said foundation top groove;

at least one connector having an angle and an extended segment such that said connector is receivable in both said foundation bottom groove and at least one of said plurality of perforations;

each of said post sides having a longitudinal post channel;

each of said post channels comprising said receivers;

each of said posts having a first end and a second end;

each of said first post ends having a peg protruding longitudinally from the end of said first post end;

each of said pegs having a width equivalent to said panel edge width;

said pegs positionable in said receivers;

a plurality of said posts comprising peg posts having a peg on said second post end;

a plurality of said posts comprising notch posts having post notches in said second post end;

said post notches comprising continuations of said post channels around said second ends;

said post notches intersecting at the apex of said second post end;

said post notches comprising said receivers;

each of said pegs of said notch posts and said peg posts freely positionable in said receivers;

said panels, posts and foundation pieces operable to form stable combinations of panels with foundation pieces and posts.

18. The modular toy construction system in claim 17, further comprising:

each of said posts having three to six sides.

19. The modular toy construction system in claim 17, further comprising:

an angle between adjacent at least two of said post channels of a said post being less than 180°.

20. The modular toy construction system in claim 17, further comprising:

a plurality of said panels being flat panels;

a plurality of said panels being angled panels;

a plurality of said panels having at least one distinctive panel surface consistent with a construction option configuration; and a plurality of said posts having at least one distinctive post surface consistent with a construction option configuration.

21. The modular toy construction system in claim 17, further comprising:

a plurality of interconnectors;

each of said interconnectors having interconnector edge widths, said interconnector edge widths being equivalent to said panel edge widths;

each of said interconnector edges being frictionally receivable in said receivers; and each of said interconnectors being capable of frictionally securing two of said posts and foundation pieces.

* * * * *